US008839651B2

(12) United States Patent
Toeniskoetter

(10) Patent No.: US 8,839,651 B2
(45) Date of Patent: Sep. 23, 2014

(54) HORIZONTALLY STACKED HEMMING PRESS

(75) Inventor: James B. Toeniskoetter, Rochester Hills, MI (US)

(73) Assignee: Hirotec America, Inc., Auburn Hills, MI (US)

( * ) Notice: Subject to any disclaimer, the term of this patent is extended or adjusted under 35 U.S.C. 154(b) by 365 days.

(21) Appl. No.: 12/858,551

(22) Filed: Aug. 18, 2010

(65) Prior Publication Data

US 2011/0048094 A1 Mar. 3, 2011

Related U.S. Application Data

(60) Provisional application No. 61/237,051, filed on Aug. 26, 2009.

(51) Int. Cl.
*B21D 11/00* (2006.01)
*B30B 7/00* (2006.01)
*B21D 39/02* (2006.01)

(52) U.S. Cl.
CPC ..... *B21D 39/021* (2013.01)
USPC ..... 72/312; 72/314; 72/384; 72/442

(58) Field of Classification Search
USPC ..... 72/312–315, 322, 323, 381, 384, 72/446–448, 215, 216, 220, 308, 309, 316, 72/441, 442, 444, 127, 174, 210, 214, 306, 72/319, 404; 29/243.57, 243.58, 509, 513, 29/505, 521; 100/141, 142, 143, 194, 195; 483/28–29
See application file for complete search history.

(56) References Cited

U.S. PATENT DOCUMENTS

| | | | | |
|---|---|---|---|---|
| 3,111,100 | A * | 11/1963 | Georgeff | 72/414 |
| 6,154,942 | A * | 12/2000 | Toeniskoetter | 29/243.58 |
| 6,324,880 | B1 * | 12/2001 | Nakamura | 72/17.3 |
| 6,386,009 | B1 * | 5/2002 | Ni et al. | 72/61 |
| 6,446,478 | B1 | 9/2002 | Muller | |
| 6,508,289 | B2 * | 1/2003 | Hagai | 156/443 |
| 6,745,608 | B2 * | 6/2004 | Miura | 72/306 |
| 7,124,491 | B2 * | 10/2006 | Toeniskoetter et al. | 29/434 |
| 7,290,423 | B2 * | 11/2007 | Carsley et al. | 72/214 |
| 2004/0035172 | A1 * | 2/2004 | Sawa | 72/214 |
| 2008/0145195 | A1 * | 6/2008 | Sacerdoti et al. | 414/225.01 |
| 2008/0184760 | A1 * | 8/2008 | Carsley et al. | 72/306 |
| 2012/0260711 | A1 * | 10/2012 | Ikeda et al. | 72/252.5 |

FOREIGN PATENT DOCUMENTS

JP 3013234 1/1991

* cited by examiner

*Primary Examiner* — Edward Tolan
*Assistant Examiner* — Leonel Vasquez
(74) *Attorney, Agent, or Firm* — Fildes & Outland, P.C.

(57) ABSTRACT

A horizontally stacked hemming press includes a horizontally disposed base. A first vertical support is mounted on the base and disposed generally perpendicular to the base. A linear track is mounted on the base. A horizontally disposed die stack including a plurality of cooperably operable die sets are horizontally arranged in series and moveable along the linear track. Each die set includes a pair of vertically disposed die shoes. A guided press platen is horizontally moveable along the linear track. A second vertical support is mounted on the base distal from the first vertical support and disposed generally perpendicular to the base. A drive mechanism is supported by one of the supports and connected to the press platen for opening and closing the die sets. Actuation of the drive mechanism horizontally moves the press platen and thereby horizontally opens one of the die sets.

20 Claims, 7 Drawing Sheets

HORIZONTALLY STACKED HEMMING PRESS

CROSS REFERENCE TO RELATED APPLICATION

This application claims the priority of U.S. Provisional Application No. 61/237,051 filed Aug. 26, 2009.

TECHNICAL FIELD

This invention relates to hemming of metal panels, and more particularly to vehicle closure panel production and hemming of vehicle closure panels.

BACKGROUND OF THE INVENTION

It is known in the art relating to hemming presses that conventional presses are typically limited to one die, while one known vertical stack press includes but is limited to two dies. Traditional hemming systems need either one hemmer per part or a press with a large die changer system for multiple parts. As assembly systems are moving towards greater flexibility, the need for assembling multiple products in a single line is increasing.

SUMMARY OF THE INVENTION

The present invention provides a horizontal stack press that may include four dies in the press, and the number of dies can be reduced or expanded from as low as two dies to as high as five or more dies.

The present horizontal stack press has the following advantages over conventional vertical press arrangements. No gravitational forces move the load in the horizontal orientation. The weight of lifting three and one-half dies (or any plurality of dies) in the vertical position would cause a significant increase in the press drive size necessary to carry the load. The height of a vertical system would cause significant increases in required clearance height if a vertical press could be configured with four dies. Adjustment of the dies would be very dangerous in the vertical position due to the height of the upper dies in the stack from the floor. Maintenance of the top structure of a vertical press would be very difficult due to the height of the press.

The present horizontal hemming press arrangement places all the equipment at a reasonable height from the floor. The present horizontal press can be shipped and installed as one integral unit, while a vertical press has to be disassembled for shipping due to height constraints of shipping by truck or similar carrier. The clamping mechanism that locks the die faces together are much lighter duty in the present horizontal press because the clamping mechanism is not subjected to the gravitational load of the dies. Safety lockouts are much lighter in the present horizontal press because of the lack of gravitational forces. The load and unload robot system is built into the top structure of the present horizontal press, saving floor space required for part handling in any traditional closure panel assembly system. This applies to press and die style, table top style and roller hemming configurations.

The present horizontal press saves up to 75% of the floor space requirements in comparison to conventional press arrangements, thereby decreasing the size of the closure panel production line. The expense, space, and complexity of a die change system are reduced by the present horizontal press.

One drive system operates all four (or any plurality of) dies. In contrast, each hemmer of a table top or individual press needs its own drive system.

More particularly, a horizontally stacked hemming press in accordance with the present invention includes a plurality of cooperably operable hemming die sets horizontally arranged in series. The plurality of hemming die sets are horizontally actuatable and movable in a generally horizontal direction.

In one embodiment, a horizontally stacked hemming press in accordance with the invention includes a horizontally disposed base. A first vertical support is mounted on the base and disposed generally perpendicular to the base. A linear track is mounted on the base. A horizontally disposed die stack including a plurality of cooperably operable die sets are horizontally arranged in series and moveable along the linear track. Each die set includes a pair of vertically disposed die shoes. A guided press platen is horizontally moveable along the linear track. A second vertical support is mounted on the base distal from the first vertical support and disposed generally perpendicular to the base. A drive mechanism is supported by one of the supports and connected to the press platen for opening and closing the die sets. Actuation of the drive mechanism horizontally moves the press platen and thereby horizontally opens one of the die sets. The drive mechanism may be actuated hydraulically or electrically.

The horizontally stacked hemming press may further include a plurality of carriages engaged with and slideable on the linear track. The die sets may be supported on the carriages for movement along the linear track. At least one of the carriages may support die shoes of adjacent die sets in an opposed disposition. The plurality of die sets may include at least a first die set and a second die set disposed between the first and second vertical supports. The first die set may include a first die shoe and a second die shoe and the second die set may include a first die shoe and a second die shoe. The first die shoe of the first die set may be fixedly mounted on one of the vertical supports, the second die shoe of the first die set may be secured to the first die shoe of the second die set on one of the carriages, and the second die shoe of the second die set may be secured to the press platen on another of the carriages. Additional die sets may be disposed between the first and second die sets. The number of carriages may be equal to the number of die sets, and the horizontal die stack may include four die sets. Each carriage may include a locking mechanism operable to lock the carriage in place and to prevent movement of the carriage along the linear track. Each die set may include a set of die clamps that releasably lock the die shoes of the die set together.

The horizontally stacked hemming press may also include a horizontally disposed upper support mounted on the first and second vertical supports. An upper linear track may be mounted on the upper support. A carriage may be engaged with and moveable along the upper linear track. The carriage may include a shelf. A material handling robot may be mounted on the shelf for moving workpieces into and out of the die sets.

Each die set may include two or more workpiece clamps that hold a hemming workpiece in a vertical disposition against a mating surface in the die set. Each workpiece clamp may include a clamp arm terminating in a clamp finger for engaging a workpiece. The clamp arm may be pivotable between a closed clamping position and an open receiving position. A pneumatic cylinder may be connected to the clamp arm. The pneumatic cylinder may bias the clamp arm in the closed position and may be capable of moving the clamp arm between the closed and open positions. A stop may limit movement of the clamp arm in the closed position. A cam may be connected to the clamp arm. The cam may be actuated by a cam driver to move the clamp arm from the closed position to the open position.

Each die set may include one or more part pusher that may be a pneumatic cylinder having an extendable rod terminating in a rod end that contacts a hemming workpiece and holds the hemming workpiece in a vertical disposition against a mating surface in the die set. Alternatively, a mechanical spring device or a liquid/gas type spring device may be substituted for the pneumatic cylinder. Each die set may include a pressure pad, and each part pusher may be mounted on the pressure pad.

A method of hemming a workpiece includes the steps of mounting a linear track on a horizontally disposed base; horizontally arranging a plurality of cooperable die sets in series along the linear track, each die set including a pair of vertically disposed die shoes; and actuating the die sets to move the die shoes along the track in a generally horizontal direction.

The method may further include the steps of supporting the die sets on a plurality of carriages that are engaged with and slideable on the linear track, wherein at least one of the carriages supports die shoes of adjacent die sets in an opposed disposition. The number of carriages may equal the number of die sets.

The method may also include the steps of vertically mounting first and second supports on opposite ends of the base, mounting a horizontally disposed upper support on the vertically mounted supports, mounting an upper linear track on the upper support, engaging a carriage including a shelf with the upper linear track for movement along the upper linear track, and mounting a material handling robot on the shelf for moving workpieces into and out of the die sets.

These and other features and advantages of the invention will be more fully understood from the following detailed description of the invention taken together with the accompanying drawings.

DETAILED DESCRIPTION OF THE INVENTION

Figure 1:
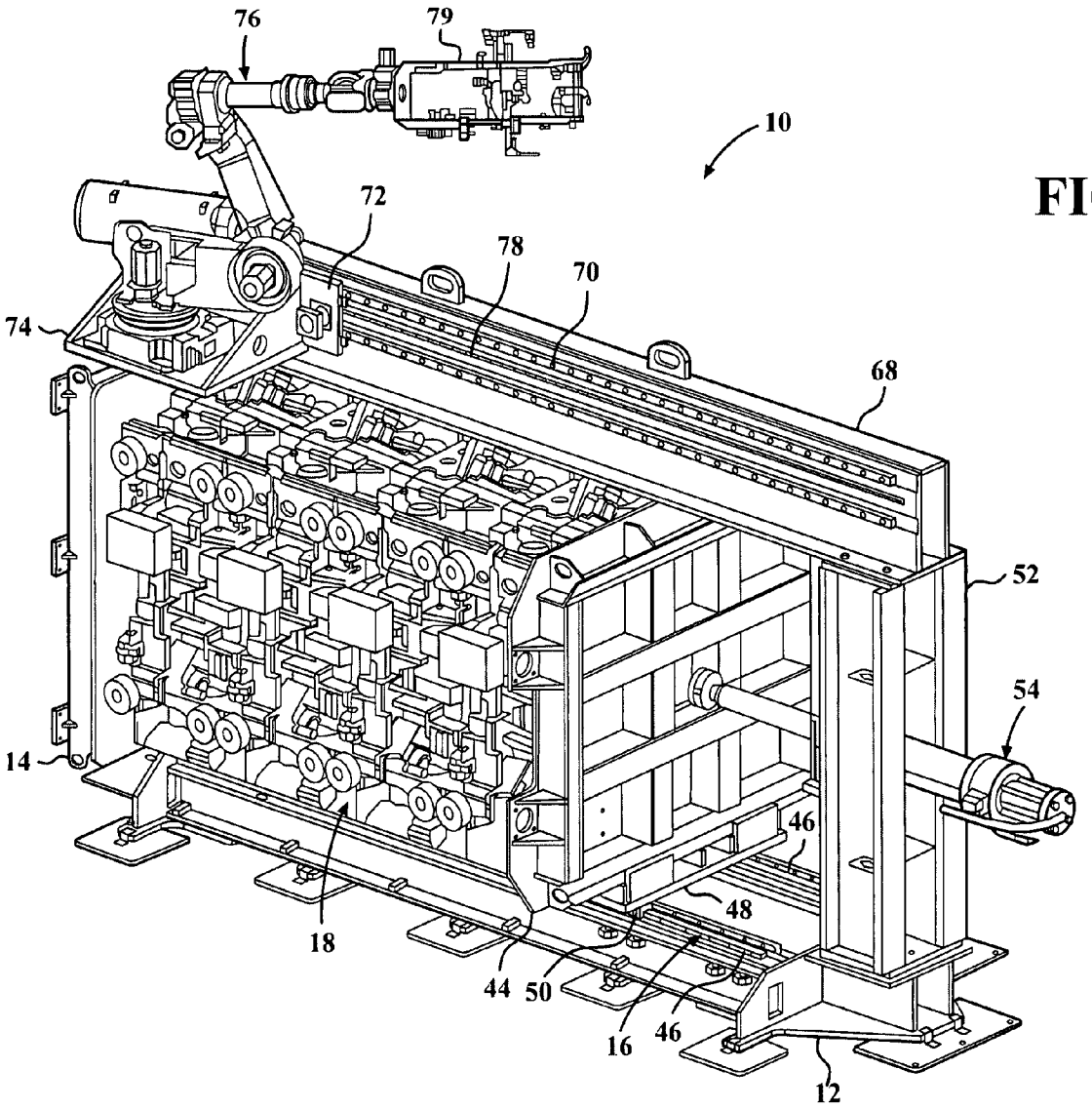
FIG. 1 is a perspective view of a horizontally stacked hemming press in accordance with the present invention.

Referring now to the drawings in detail, numeral 10 generally indicates a horizontally stacked hemming press in accordance with the present invention. The horizontal hemming press 10 includes a plurality of cooperably operable hemming die sets horizontally arranged in series, and in contrast to conventional presses the plurality of hemming die sets are horizontally actuated and moved (opened/closed) in a generally horizontal direction. The horizontal hemming press 10 is shorter (and therefore has a reduced height requirement) in comparison to conventional vertical presses. The horizontal hemming press 10 also has a smaller footprint and therefore provides a floor space savings in comparison to using a plurality of presses each having a dedicated die set, to using a plurality of table top hemmers each for a dedicated part/product, and to using a plurality of roller hemming cells each for a dedicated part/product. The horizontal hemming press 10 further provides an energy savings in comparison to using a plurality of hemming presses each having a dedicated hydraulic power unit. Additionally, since the plurality of die sets of horizontal hemming press 10 are actuated by a single press drive, the present invention eliminates the need for die change equipment and in turn reduces floor space requirements that would have been needed for a die changer and die sets that are not in use. Furthermore, the horizontal hemming press 10 provides a safer work environment in comparison to a vertical press because during cleaning or general maintenance operations, a worker is not required to be positioned under a heavy (e.g., seven ton), vertically suspended die.

Figure 2:
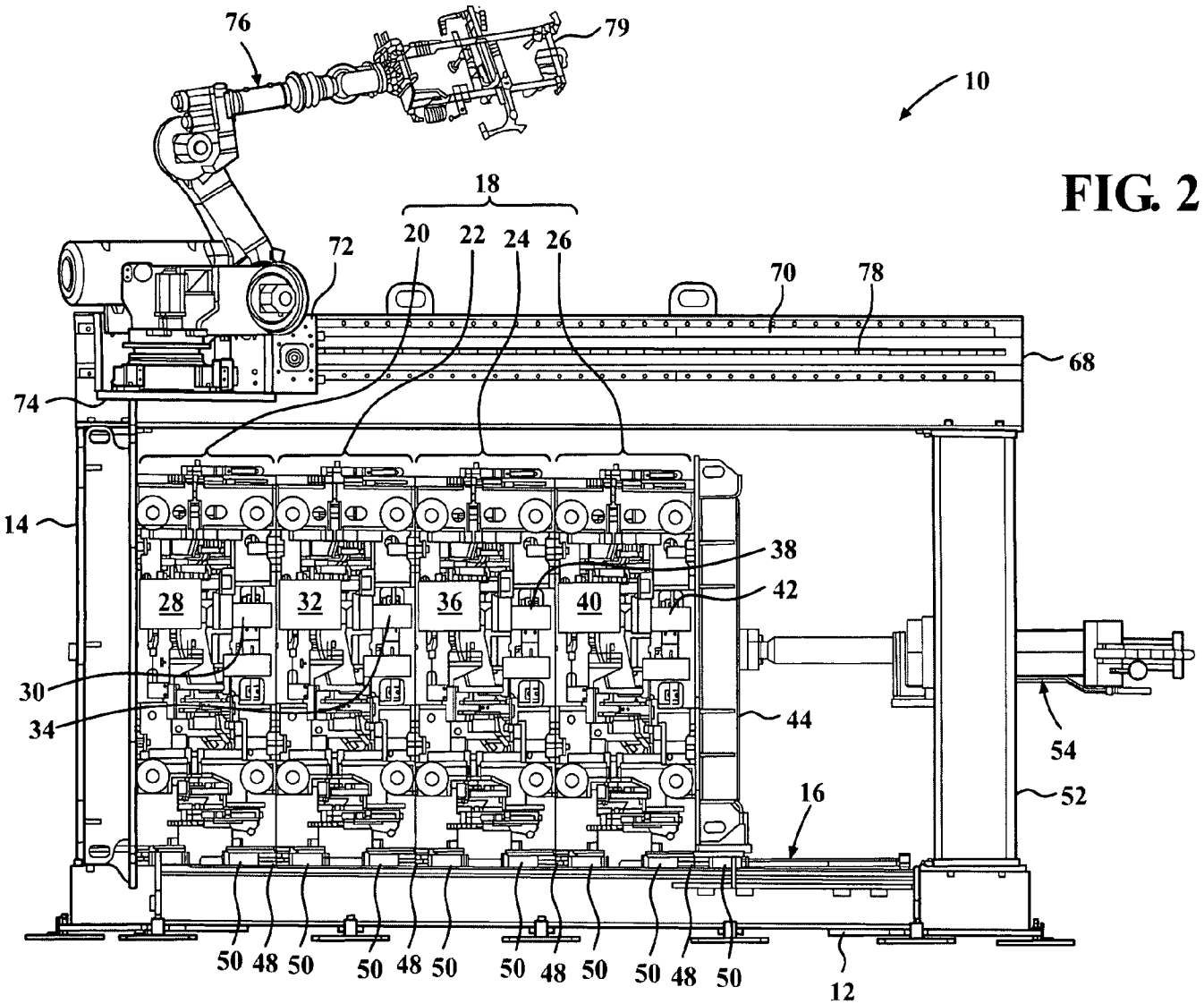
FIG. 2 is a side view of the horizontally stacked hemming press in a closed position.
Figure 3:
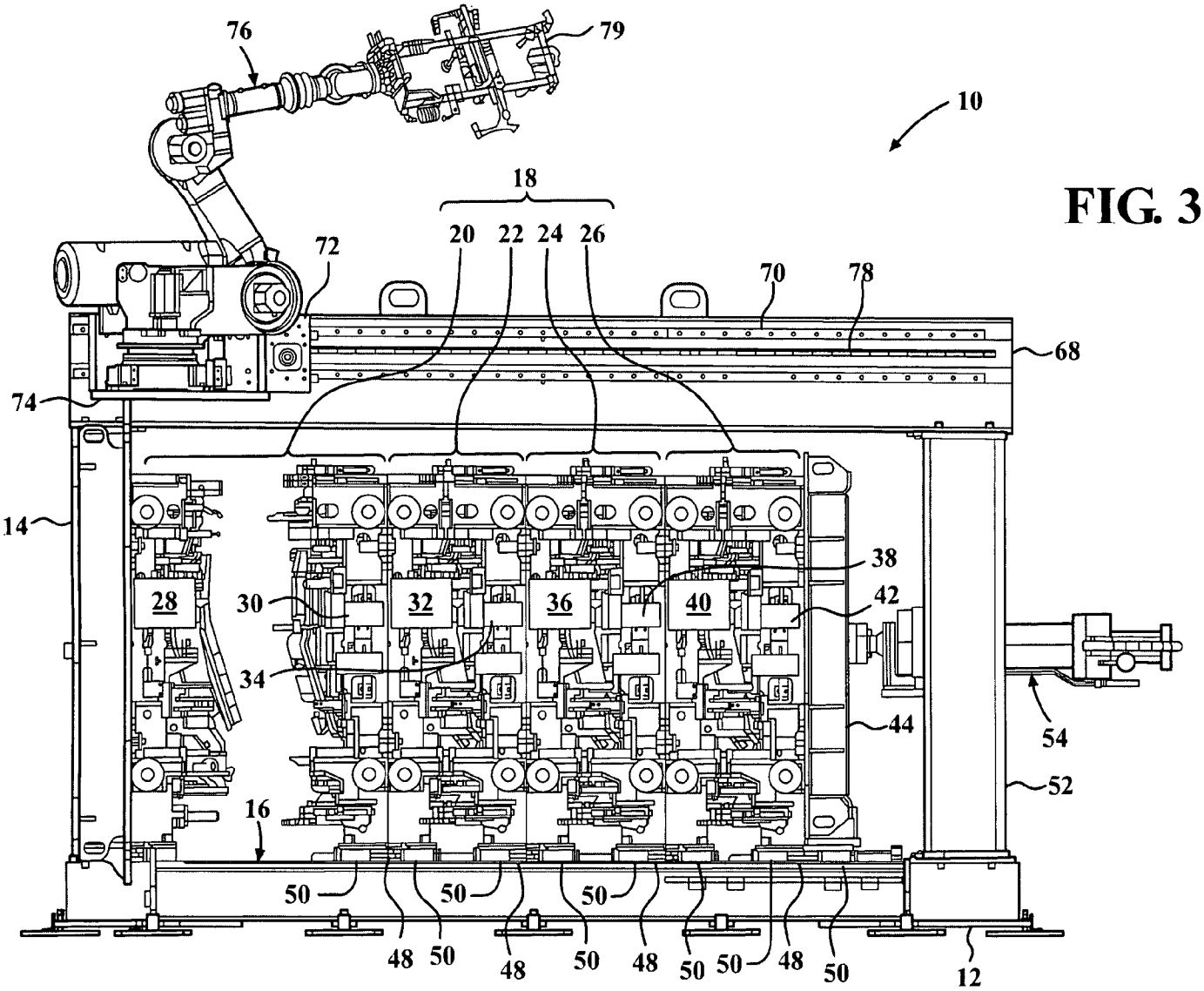
FIG. 3 is a side view of the horizontally stacked hemming press in an open position.

As shown in FIGS. 1-3, the horizontal hemming press 10 includes a horizontally disposed base 12, a first vertical support 14 mounted on the base and disposed generally perpendicular to the base, and a linear track 16 mounted on the base. A horizontally disposed die stack 18 is supported by the base and includes a plurality of cooperably operable die sets 20, 22, 24, 26 horizontally arranged in series and moveable along the linear track 16. The die sets 20, 22, 24, 26 are "stacked" one next to another in a horizontal row (i.e., "horizontally arranged in series"), while each die set is rotated 90° from a conventional disposition such that each die set is supported on its side in a generally vertical disposition. Each die set includes a pair of vertically disposed die shoes: die set "A" 20 includes die shoe "A1" 28 and opposite cooperating die shoe "A2" 30, die set "B" 22 includes die shoe "B1" 32 and opposite cooperating die shoe "B2" 34, die set "C" 24 includes die shoe "C1" 36 and opposite cooperating die shoe "C2" 38, and die set "D" 26 includes die shoe "D1" 40 and opposite cooperating die shoe "D2" 42. While in the embodiment shown the press 10 includes four die sets, a horizontal stack press in accordance with the present invention may have any number of die sets greater than or equal to two. For example, the disclosed embodiment including four die sets can be made to accept fewer die sets by using ram extensions to fill the missing die gaps. Alternatively, the disclosed embodiment may be lengthened to accommodate more than four die sets. Each die set may be capable of performing of different hemming or stamping operation (e.g., 30 degree hem, 45 degree hem, 60 degree hem, or 90 degree hem) and/or each die set may accommodate a different panel shape (e.g., a vehicle door panel, a vehicle decklid panel, a vehicle hood panel, etc.).

A guided press platen 44 is also moveable along the linear track 16 in concert with the die set(s). The linear track 16 may include a set of spaced rails 46, and a plurality of carriages 48 may be engaged with and slideably moveable on the rails via slide bearings 50 or similar. Alternatively, the track/guide 16 may include wear plates and gibs. The carriages 48 generally support the die sets for linear back-and-forth movement along the track 16. The number of carriages should be equal to the total number of die sets. At least one of the carriages supports die shoes of adjacent die sets in an opposed (i.e., back-to-back) disposition such that these two die shoes face opposite directions. In general, a first die shoe of a first die set is fixedly mounted on the first vertical support 14 at one end of the horizontal die stack 18 while a second die shoe of the first die set is secured to a carriage 48. A first die shoe of a second die set may be secured to the second die shoe of the first die set on the carriage 48, while a second die shoe of the second die set is secured to the press platen 44 on another carriage 48 at an end of the horizontal die stack 18 opposite the first vertical support 14. Additional die sets are disposed between the first and second die sets such that the die shoes of each die set are mounted on different carriages 48. In the specific embodiment shown in the drawings, die shoe "A1" 28 of die set "A" 20 is fixedly mounted on the first vertical support 14, and die shoe "A2" 30 of die set "A" is secured to die shoe "B1" 32 of die set "B" 22 in a back-to-back opposed disposition on one of the carriages 48. Die shoe "B2" 34 of die set "B" 22 is similarly secured to die shoe "C1" 36 of die set "C" 24 on another of the carriages 48, and die shoe "C2" 38 of die set "C" 24 is secured to die shoe "D1" 40 of die set "D" 26 on yet another carriage 48. Die shoe "D2" 42 of die set "D" 26 is secured to the press platen 44 on another carriage 48.

A second vertical support 52 is mounted on the base 12 and disposed generally perpendicular to the base. A drive mechanism 54 is supported by the second vertical support 52 and is connected to the press platen 44 for opening and closing the die sets 20, 22, 24, 26. The drive mechanism is shown as a hydraulic cylinder, but alternatively may be an electric drive arrangement. The drive mechanism is sized to move the mass of the hem die(s) horizontally and to apply the force required to press/hem a workpiece. The horizontal motion of the drive and dies eliminates the requirement for a counterbalance hydraulic system which is necessary for lifting/raising the dies in a vertical motion die press.

Figure 4:
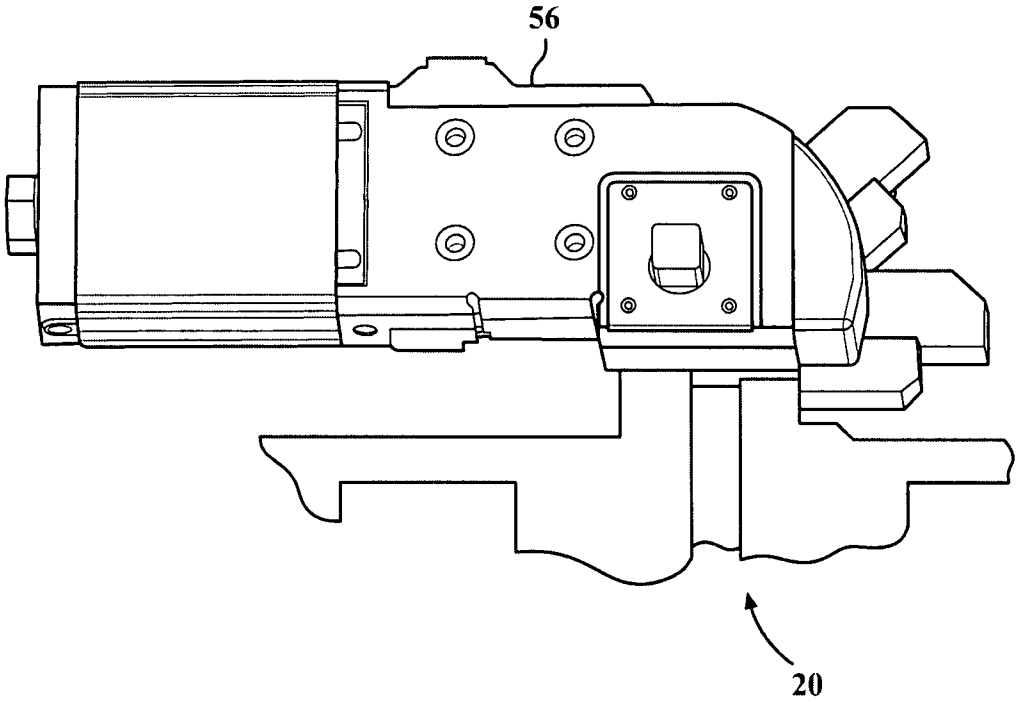
FIG. 4 is an enlarged, perspective view of a die set die clamp of the horizontally stacked hemming press.

As shown in more detail in FIG. 4, each of the die sets (for example, die set 20) includes one or more clamping mechanisms such as die clamps 56 that lock the die shoes of a die set together in a closed disposition. The clamping mechanisms that lock the die shoe faces together are significantly lighter duty than clamps used in vertical presses because they are not subject to the gravitational load of the dies. To open one of the die sets, the clamp(s) 56 of that die set are released while the clamp(s) 56 of the other die sets remain engaged. The press platen 44 is retracted, and the die shoes on the press platen 44 side of the die stack 18 move with the press platen while the die shoes on the first vertical support 14 side of the die stack 18 remain stationary (for examples, see FIGS. 2 and 3). The die shoes of the unlocked die set thereby separate and open, allowing a part (e.g., panel workpiece) to be loaded or unloaded from the die.

Figure 5:
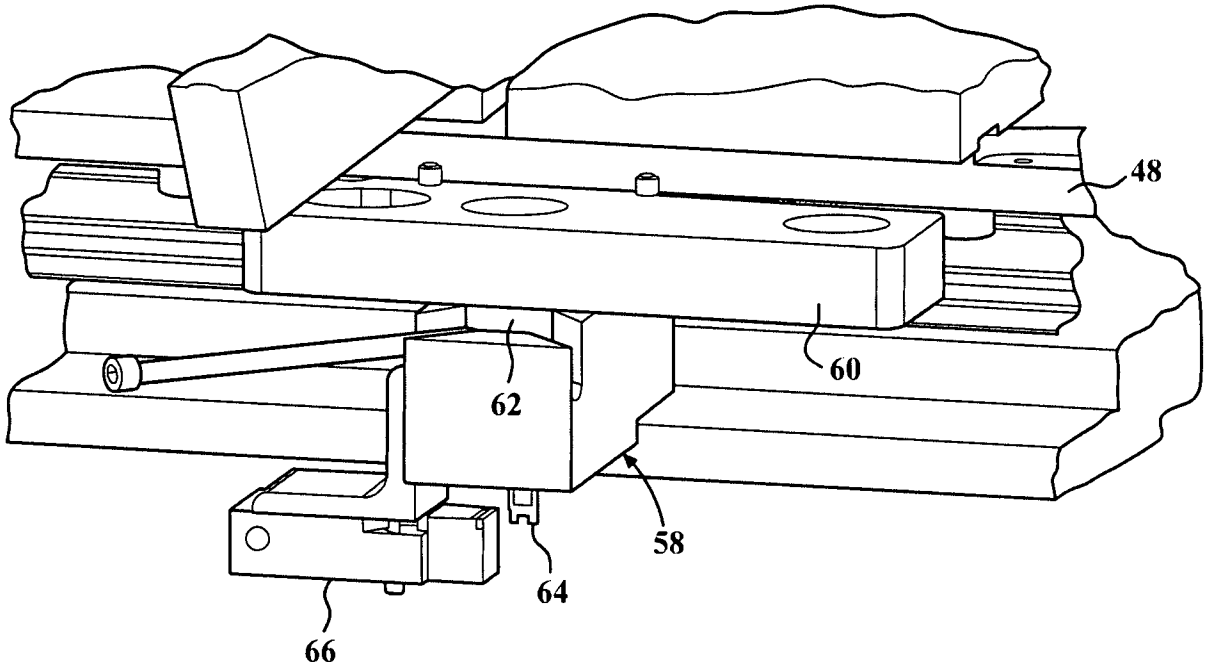
FIG. 5 is an enlarged, perspective view of a carriage locking mechanism of the horizontally stacked hemming press.

As shown in FIG. 5, each carriage 48 includes a locking mechanism 58 that locks the carriage in place and prevents movement of the carriage and mounted hem die along the linear track 16 for tasks such as servicing. The safety locking mechanisms 58 are lighter duty than the safety lockouts used in vertical presses because the die set(s) do not have to be protected from falling due to gravity as is the case in a vertical press. Each locking mechanism 58 may include a plate 60 mounted on the carriage 48 and a pin 62 that is received in the plate. The pin 62 may be manually engaged into the plate 60 during servicing of the hemming press 10. The locking mechanism 58 also may include an interlock key 64 and a safety switch 66. When the pin 62 is lifted out of and removed from its storage position, the interlock key 64 is disengaged from the safety switch 66, which disables the switch and in turn disables the hemming press.

Returning to FIGS. 1-3, the hemming press 10 may include a horizontally disposed upper support 68 mounted on the first and second vertical supports 14, 52. An upper linear track 70 including a rail or similar may be mounted on a side of the upper support 68. A vertically disposed carriage 72 may be engaged with and moveable along the upper linear track 70. The carriage 72 may include a horizontally disposed shelf 74, and a multi-axis (e.g., six axis) material handling robot 76 such as a multi-axis robotic arm or similar may be mounted on the shelf for moving workpieces into and out of the die sets 20, 22, 24, 26. The material handling robot 76 may be indexed along the upper linear track 70 by a linear seventh axis drive system 78. The material handling robot 76 has end-of-arm tooling 79 (such as a clamping spider or similar) mounted thereon that can engage and secure panel workpieces or other similar parts for loading and unloading to and from all of the die sets of the hemming press 10. The material handling robot 76 reduces the floor space requirements of the hemming press 10 in comparison to conventional presses because the load/unload material handling robot is built into the upper member of the press and is therefore not floor mounted.

Figure 6:
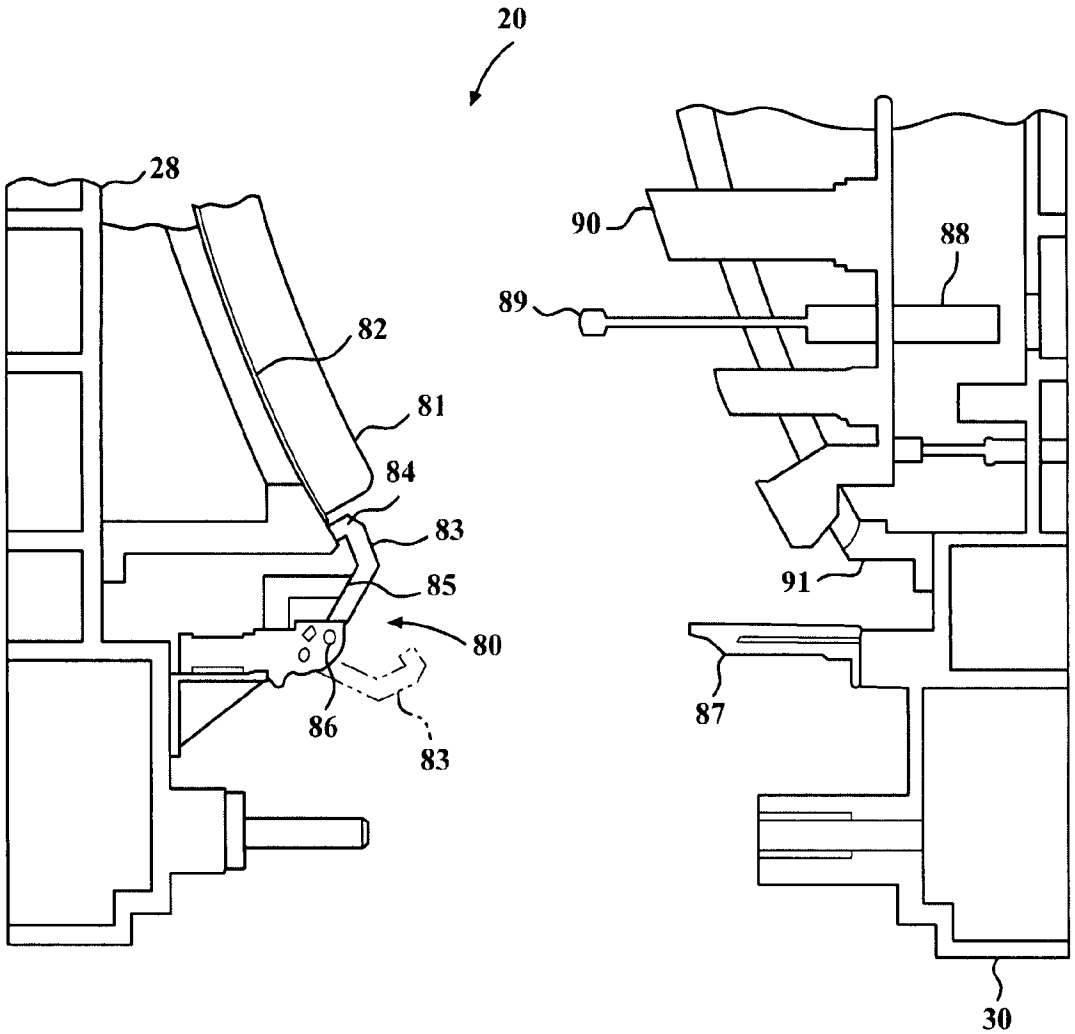
FIG. 6 is a partial side view of die set of the horizontally stacked hemming press having a set of nested panels secured therein.
Figure 7:
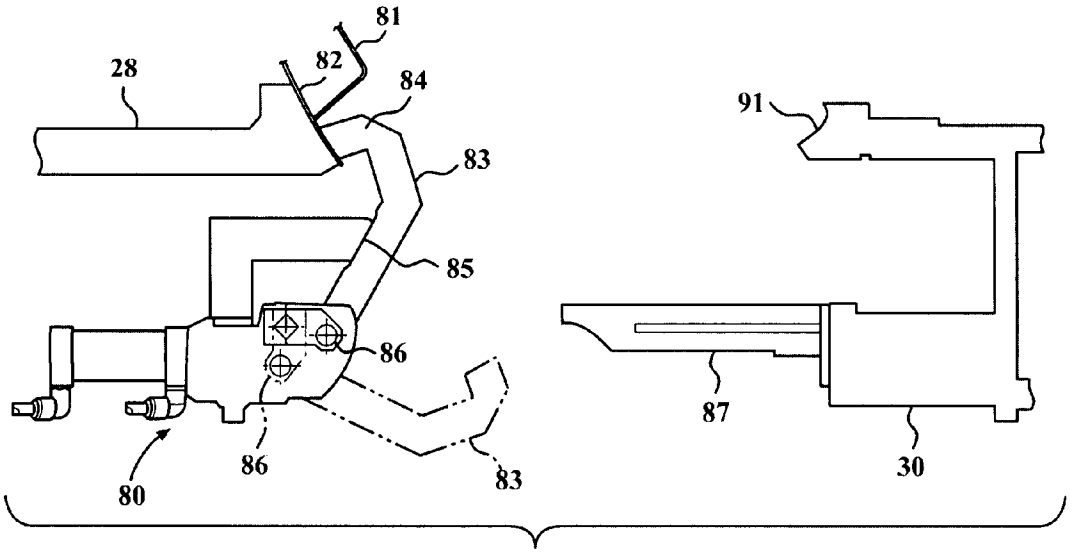
FIG. 7 is an enlarged, side view of a workpiece clamp of the horizontally stacked hemming press in a closed position.
Figure 8:
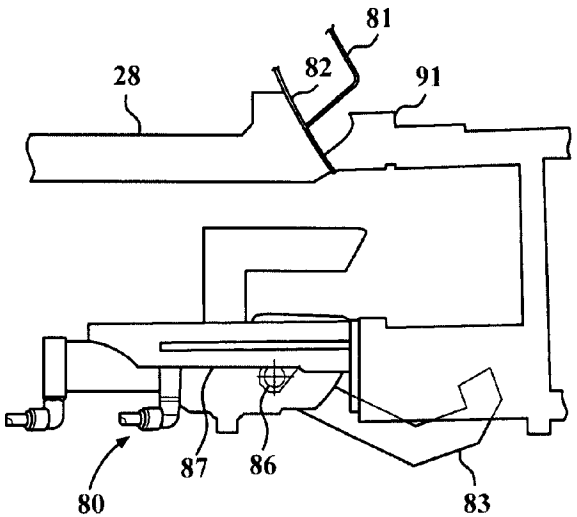
FIG. 8 is an enlarged, side view of the workpiece clamp of FIG. 7 in an open position.

Turning to FIGS. 6-8, each die set of the hemming press (for example die set 20) may include two or more workpiece clamp devices 80 that are mounted to one of the die shoes of the die set (for example die shoe 28). The workpiece clamp devices 80 secure workpieces such as a married set of nested panels 81 to a generally vertical mating surface 82 of the die shoe 28. Each clamp device 80 may include a clamp arm 83 pivotable between a closed clamping position shown in FIGS. 6 and 7 and an open receiving position shown in FIG. 8 (and shown in phantom line in FIGS. 6 and 7). The clamp arm 83 includes a finger 84 on a distal end thereof that engages the workpiece panels 81 and presses the panels against the mating surface 82 in the closed clamping position. A positive stop 85 limits the movement of the clamp arm 83 in the closing direction. The clamp arm 83 is connected to a cam 86 that is actuated by a cam driver 87 mounted on the opposing die shoe (for example die shoe 30) of the die set. The clamp arm may be pneumatically actuated and maintained/biased in the closed workpiece clamping position by pneumatic pressure, and the clamp arm is opened by the cam driver 87 on the opposing die shoe. The opening of the clamp arm 83 can be timed to open at a set position in the travel of the die set from the die open position to the die closed position.

Each die set may also include one or more pneumatic cylinders 88 or similar including a cylinder rod end 89 that functions as a part pusher. The rod end 89 engages the workpiece held in the die when the die closes to hold the workpiece to the vertical mating surface 82. Pneumatic pressure is supplied to the cylinder 88 to extend and bias the rod end 89 outwardly. As the die set closes, the rod end 89 comes into contact with the workpiece in the die, and the further closing of the die set compresses the cylinder 88 to keep the rod end 89 in urged engagement with the workpiece. This holds the workpiece to the mating surface 82 while the clamp arm(s) 83 open and retract away from the workpiece as described above. In one arrangement, a pneumatic circuit including a valve and a regulator is connected to the cylinder 88. The valve is shifted to allow pneumatic pressure to flow into the cylinder 88 to actuate the cylinder to its extended position, and it is held in this position to allow constant pressure in the cylinder. The regulator governs the pneumatic pressure in the circuit. When the die set closes and the workpiece contacts the rod end 89 of the cylinder 88, the cylinder is compressed which causes the pressure in the circuit to increase slightly. The cylinder 88 may therefore be a small bore cylinder operated at low pressure to decrease the amount of pressure buildup in the circuit. Alternatively, the regulator may be programmable. In this arrangement, when the cylinder 88 is compressed, the pressure in the circuit is bled off and kept constant by the programmable regulator. The programmable regulator can also be used to change the velocity of the rod end's 89 movement when the rod end is extended. This is useful when the die set's velocity during an opening motion is greater than the velocity of the rod end 89 at its regulated pressure. The die set can travel faster than the rod end 89 can travel when the cylinder 88 is set at a low pressure. The programmable regulator can be programmed to change the pressure during the opening of the press to allow the rod end 89 to keep up with the velocity of the opening die set, thereby maintaining contact between the rod end 89 and the workpiece until the part clamp(s) 80 are activated. Alternatively, the part pusher may comprise a mechanical spring mechanism similar to a compression spring or liquid/gas springs.

In use, the EOAT 79 of the material handling robot 76 approaches the hemming press 10 with an un-hemmed workpiece such as a set of nested panels 81 (e.g., constituting a vehicle closure panel). A request is made to a controller or similar to open the desired die set. The die clamp(s) 56 locking the requested die set are disengaged and the drive mechanism 54 is activated to move in a retracting direction as shown in FIGS. 2 and 3, thereby separating and opening the die shoes of the requested die set. The workpiece clamps 80 are moved/held in an open position, and the rod end part pusher(s) 89 are extended. The robot 76 then inserts the un-hemmed nested panels 81 in the die in a vertical, upright orientation against the mating surface 82, and unloads a hemmed workpiece (if present from a previous hemming operation) from the die. Prior to releasing the un-hemmed panels, the workpiece clamps 80 are pneumatically actuated into the closed position to hold the nested panels 81 against the mating surface 82. As the workpiece clamps 80 close, each clamp arm 83 contacts the positive stop 85, ensuring that the clamp arm does not extend fully to its over center locking position. The clamp finger 84 of each clamp arm 83 is set to the panels with a small clearance to allow the panels to be held in position while also allowing for the inner panel to move laterally to align with gauge pins on a pressure pad 90 when the die set is closed. The robot 76 then clears the EOAT 79 from the area between the die shoes of the die set, and the drive mechanism 54 is activated to move in a protracting, closing direction. Activation of the drive mechanism 54 closes the die set. During the closing motion, the cylinder rod end part pushers 89 mounted to the pressure pad 90 make the first contact with the nested panel workpiece 81. The part pushers 89 thereby begin to compress prior to the cam drivers 87 contacting the cams 86 of the workpiece clamps 80. As the closing motion continues, the each cam driver 87 actuates a workpiece clamp 80 to rotate the clamp arms 83 into the open position as shown in FIGS. 7 and 8. The valve for the workpiece clamps 80 continues to be spooled to deliver pressurized air to the clamp arms' pneumatic cylinders to urge the clamp arms 83 in the closing direction. The mechanical interaction between the cam drivers 87 and the cams 86 overcome the closing pressure to force the clamp arms 83 open. Pressurized air is maintained in the clamp arm cylinders to keep the clamp arm cams 86 in urged engagement with the cam drivers 87, and through the die set stroke of the press the workpiece clamps 80 are held open by the cam drivers. As the die shoes of the die set continue to move towards each other, the final hem steel 91 (for example) contacts the nested panel workpiece 81 as shown in FIG. 8 to hem the periphery of the panels together. At this point in the hemming operation, the press 10 is in a "home" position waiting for instructions for working on the next workpiece. By leaving finished parts in the die and making the closed position of the press the home position, the press is capable of running in a synchronous mode (batch of one) at high speeds. If synchronous production is not required, or a lower volume synchronous rate is desired, the press can run from an open home position in which finished parts are not left in the dies. In this case, after the die set is closed to hem the workpiece, the drive mechanism is activated to move in the retracting direction to open the die shoes of the die set. The closing steps described above are reversed. The drive mechanism 54 is activated to move the die shoes away from each other. As the die shoes separate, the final hem steel 91 first disengages from the workpiece 81, then the pressure pad 90 disengages from the workpiece. The part pushers 89 remain in contact with the workpiece 81 at this time to hold the workpiece against the mating surface 82. Next, the cam drivers 87 move away from the cams 86, which allows the clamp arms 83 to close and hold the workpiece 81 to the mating surface 82. After the workpiece clamps 80 are closed to hold the workpiece, the cylinder rod end part pushers 89 move away from the workpiece. Once the die set is open, the robot 76 then picks up and removes the workpiece from the die using the EOAT 79 and by activating release of the workpiece clamps 80.

Hemming of the workpieces in a vertical orientation allows for various workpiece loading/unloading schemes including loading the workpieces to the die set anvil and unloading the workpieces from the die set punch, loading and unloading the workpieces to and from the die set anvil, loading the workpieces to the die set punch and unloading the workpieces from the die set anvil, and loading and unloading the workpieces to and from the die set punch.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A horizontally stacked hemming press comprising:

a horizontally disposed base;

a linear track mounted on said base;

a plurality of cooperably operable hemming die sets horizontally arranged back-to-back in series along the same said linear track;

a drive mechanism operatively connected to said plurality of hemming die sets; and clamping mechanisms that operatively lock and unlock said plurality of hemming die sets;

wherein said plurality of hemming die sets are horizontally actuatable via said drive mechanism and movable in a generally horizontal direction along the same said linear track, and only one of said hemming die sets opens and closes at a time by releasing and engaging one said clamping mechanism while the other of said hemming die sets remain in a closed disposition.

2. A horizontally stacked hemming press comprising:

a horizontally disposed base;

a first vertical support mounted on said base and disposed generally perpendicular to said base;

a linear track mounted on said base;

a horizontally disposed die stack including a plurality of cooperably operable die sets horizontally arranged in series and moveable along said linear track, each die set including a pair of vertically disposed die shoes;

a guided press platen horizontally moveable along said linear track;

a second vertical support mounted on said base distal from said first vertical support and disposed generally perpendicular to said base;

a drive mechanism supported by one of said supports and connected to said press platen for opening and closing said die sets;

wherein actuation of said drive mechanism horizontally moves said press platen and thereby horizontally opens only one of said die sets while the other of said hemming die sets remain in a closed disposition.

3. The horizontally stacked hemming press of claim 2, including:

a plurality of carriages engaged with and slideable on said linear track;

said die sets being supported on said carriages for movement along said linear track.

4. The horizontally stacked hemming press of claim 3, wherein at least one of the carriages supports die shoes of adjacent die sets in an opposed disposition.

5. The horizontally stacked hemming press of claim 3, wherein said plurality of die sets includes at least a first die set and a second die set disposed between said first and second vertical supports, said first die set including a first die shoe and a second die shoe and said second die set including a first die shoe and a second die shoe;

said first die shoe of said first die set being fixedly mounted on one of said vertical supports, said second die shoe of said first die set being secured to said first die shoe of said second die set on one said carriage, and said second die shoe of said second die set being secured to said press platen on another said carriage.

6. The horizontally stacked hemming press of claim 5, wherein additional die sets are disposed between said first and second die sets.

7. The horizontally stacked hemming press of claim 3, wherein the number of carriages is equal to the number of die sets.

8. The horizontally stacked hemming press of claim 2, wherein said horizontal die stack includes four die sets.

9. The horizontally stacked hemming press of claim 3, wherein each carriage includes a locking mechanism operable to lock said carriage in place and to prevent movement of said carriage along said linear track.

10. The horizontally stacked hemming press of claim 2, including:

a horizontally disposed upper support mounted on said first and second vertical supports;

an upper linear track mounted on said upper support;

a carriage engaged with and moveable along said upper linear track, said carriage including a shelf; and a material handling robot mounted on said shelf for moving workpieces into and out of said die sets.

11. The horizontally stacked hemming press of claim 2, wherein each die set includes a set of die clamps that releasably lock the die shoes of the die set together.

12. The horizontally stacked hemming press of claim 2, wherein said drive mechanism is actuated hydraulically or electrically.

13. The horizontally stacked hemming press of claim 2, wherein each die set includes two or more workpiece clamps that hold a hemming workpiece in a vertical disposition against a mating surface in said die set.

14. The horizontally stacked hemming press of claim 13, wherein each said workpiece clamp includes:

a clamp arm terminating in a clamp finger for engaging a workpiece, said clamp arm being pivotable between a closed clamping position and an open receiving position;

a pneumatic cylinder connected to said clamp arm that biases said clamp arm in the closed position and is capable of moving said clamp arm between said closed and open positions;

a stop that limits movement of said clamp arm in the closed position; and a cam connected to said clamp arm, said cam being actuated by a cam driver to move said clamp arm from said closed position to said open position.

15. The horizontally stacked hemming press of claim 2, wherein each die set includes one or more part pusher comprising one selected from a pneumatic cylinder, a mechanical spring device, and a liquid/gas type spring device, said part pusher further including an extendable rod terminating in a rod end that contacts a hemming workpiece and holds said hemming workpiece in a vertical disposition against a mating surface in said die set.

16. The horizontally stacked hemming press of claim 15, wherein each die set includes a pressure pad, each said part pusher being mounted on said pressure pad.

17. A method of hemming a workpiece including the steps of:

mounting a linear track on a horizontally disposed base;

horizontally arranging a plurality of cooperable die sets back-to-back in series along the same said linear track, each die set including a pair of vertically disposed die shoes;

actuating said die sets to move said die shoes along the same said linear track in a generally horizontal direction, wherein only one of said die sets is opened and closed at a time while the other of said die sets remain in a closed disposition;

providing a workpiece; and inserting said workpiece in one of said die sets and hemming said workpiece.

18. The method of claim 17, including the step of:

supporting said die sets on a plurality of carriages that are engaged with and slideable on said linear track;

wherein at least one of the carriages supports die shoes of adjacent die sets in an opposed disposition.

19. The method of claim 18, wherein the number of carriages equals the number of die sets.

20. The method of claim 17, including the steps of:

vertically mounting first and second supports on opposite ends of said base;

mounting a horizontally disposed upper support on said vertically mounted supports;

mounting an upper linear track on said upper support;

engaging a carriage including a shelf with said upper linear track for movement along said upper linear track; and mounting a material handling robot on said shelf for moving workpieces into and out of said die sets.

* * * * *